US009089208B2

(12) United States Patent
Zimmerman

(10) Patent No.: US 9,089,208 B2
(45) Date of Patent: Jul. 28, 2015

(54) TRAY ATTACHMENT

(71) Applicant: Doreen L. Zimmerman, Paradise, CA (US)

(72) Inventor: Doreen L. Zimmerman, Paradise, CA (US)

( * ) Notice: Subject to any disclaimer, the term of this patent is extended or adjusted under 35 U.S.C. 154(b) by 0 days.

(21) Appl. No.: 14/553,240

(22) Filed: Nov. 25, 2014

(65) Prior Publication Data

US 2015/0164221 A1 Jun. 18, 2015

Related U.S. Application Data

(60) Provisional application No. 61/915,349, filed on Dec. 12, 2013, provisional application No. 61/944,967, filed on Feb. 26, 2014.

(51) Int. Cl.
*A47B 57/00* (2006.01)
*A47B 23/02* (2006.01)
*A47B 13/16* (2006.01)

(52) U.S. Cl.
CPC ..... *A47B 23/02* (2013.01); *A47B 13/16* (2013.01)

(58) Field of Classification Search
CPC ..... A47B 96/02; A47B 96/024; D06F 81/06; F16B 2/12; F16B 2/10
USPC ..... 108/25, 26, 49, 152, 97, 42; 297/174 CD, 174 R, 147, 153, 135; 211/88.01, 90.01, 126.5, 133.3; 248/229.13, 229.12, 229.2, 229.22, 248/229.23, 229.24, 226.11, 228.3, 228.4
See application file for complete search history.

(56) References Cited

U.S. PATENT DOCUMENTS

| | | | | | |
|---|---|---|---|---|---|
| 225,187 | A * | 3/1880 | Warren | 108/97 |
| 506,283 | A * | 10/1893 | Tracy | 108/97 |
| 1,190,113 | A * | 7/1916 | Cohen | 108/97 |
| 1,223,637 | A * | 4/1917 | Swain | 108/97 |
| 1,486,018 | A * | 3/1924 | Henrie | 108/97 |
| 2,580,855 | A * | 1/1952 | Abraham | 108/97 |
| 2,709,563 | A * | 5/1955 | Starkey | 108/97 |
| 2,867,401 | A * | 1/1959 | Sheahan | 108/47 |
| 3,741,131 | A * | 6/1973 | Leadbetter | 108/97 |
| 5,205,222 | A * | 4/1993 | Bernard | 108/97 |
| 5,282,427 | A * | 2/1994 | Steinhilber | 108/97 |
| 5,584,458 | A * | 12/1996 | Rando | 248/231.41 |
| 5,673,888 | A * | 10/1997 | Garguilo | 248/228.3 |
| 5,722,329 | A * | 3/1998 | Weng | 108/47 |
| 5,893,331 | A * | 4/1999 | Diletto | 108/48 |
| 6,910,429 | B1 * | 6/2005 | Matay et al. | 108/44 |
| 6,984,066 | B2 * | 1/2006 | Borom | 108/97 |
| 7,059,448 | B2 * | 6/2006 | Beechler | 211/59.1 |
| 7,475,937 | B2 * | 1/2009 | McGrew et al. | 108/26 |
| 8,857,775 | B1 * | 10/2014 | Clearman et al. | 248/229.13 |

* cited by examiner

*Primary Examiner* — Jose V Chen

(57) ABSTRACT

A tray attachment is provided for use with household items. A first embodiment and a second embodiment allow the tray attachment to be used with horizontal features (e.g. tables) and vertical features (e.g. arm rests). For use with horizontal features, the first embodiment uses a pair of clamps and handles connected below a planar surface. The clamps can be pressed against the bottom of a table, held in place thanks to the interaction between a locking mechanism and retention mechanism. A planar body serves is connected atop the carriage and serves as a tray, including an indent for holding items such as plates or cups. In the second embodiment a moveable clamp jaw is clamped against a stationary clamp jaw by means of a carriage which slides along an elongated track. The planar body again serves as a tray, effectively extending the usable area of a table or similar feature.

14 Claims, 15 Drawing Sheets

TRAY ATTACHMENT

The current application claims a priority to the U.S. Provisional Patent application Ser. No. 61/915,349 filed on Dec. 12, 2013 and claims a priority to the U.S. Provisional Patent application Ser. No. 61/944,967 filed on Feb. 26, 2014.

FIELD OF THE INVENTION

The present invention relates generally to a tray attachment device. More specifically, the present invention serves as a retrofit tray adapter for tables, chairs, general furniture, and indeed any items that a person may wish to attach a tray to. The present invention is capable of being attached to either a vertical or horizontal feature, e.g. an arm rest or the end of a table.

BACKGROUND OF THE INVENTION

Raising a child is a challenging and stressful task. Eighteen years of care and responsibility can amount to immense stress and joy. A significant portion of that stress is a result of kids being messy and unorganized, the majority of the time occurring during a meal of some sorts. This is especially prominent in food service institutes such as restaurants and cafeterias. Due to their small size, children usually can't sit at the table comfortably so most food service companies provide a booster seat for kids. While this seat adequately compensates for the child's lack of height, it doesn't provide an eating surface. The present invention seeks to provide a universally adaptable tray device for horizontal and vertical surfaces of furniture, like the booster seat. The present invention is a quick and easy to use tray that may be attached to the vast majority of furniture. It is ideal for providing an eating surface for kids wherever they sit. Since one of the top priorities restaurants and other food service institutes have is cleanliness, this invention is ideally suited for them. Providing a child with a tray to eat off reduces the amount of food and other food service items that will end up on the surrounding surfaces and the floor. This reduces the stress on the parents since in such situations the parents feel embarrassed of their kid's actions. In addition, as a result of the present invention, the work load for the employees of said restaurant is lighter. Furthermore, due to the present invention's universal fastening means, it may be used in conjunction with a multitude of different chairs and tables. The present invention may also be utilized in the same manner at home. The present invention may be attached to a crib, a children's chair, and on any table surface. The present invention may also act as a normal flat surface. One could use it to hold writing utensils, make-up, remotes, wireless mouse and keyboards, flowers, paint palettes, and other light items. The present invention is an ideal accessory to have around the house because it is compatible with majority of the furniture in a household. The present invention is not limited to use with children, and indeed may be applied in any situation or environment where table space is limited or unavailable.

Another potential application of the present invention is the medical field; health care professionals may find themselves in situations where temporary planar surfaces are desirable. For example, the present invention may be used to provide a temporary table or tray for the placement of medical devices, tools, or even personal belongings. The present invention could be secured to counters, bed frames, chairs, and other existing items. Beyond household and medical use, other examples of potential applications include but are not limited to restaurants, office settings, and travel.

DETAIL DESCRIPTIONS OF THE INVENTION

All illustrations of the drawings are for the purpose of describing selected versions of the present invention and are not intended to limit the scope of the present invention.

The present invention is a tray attachment which is designed to be compatible with a multitude of furniture designs. Different embodiments of the present invention are provided to ensure the aforementioned compatibility. A first embodiment allows the attachable tray to be coupled to horizontally oriented features, such as tables. A second embodiment allows the attachable tray to be coupled to vertically oriented features, such as arm rests. The first embodiment can be used to expand the available surface for a table or similar furnishing, while the second embodiment allows the present invention to provide a dining surface for chairs and similar furniture which does not have an associated table. Together, these two embodiments allow the present invention to be utilized with common household items, though additional embodiments may be provided for use with uncommon furniture designs. Several different clamping mechanisms are possible for the first embodiment; while a ratchet design, push design, vise grip design, and spring clamp design are discussed, this does not preclude the use of other clamping mechanism designs in further variants of the present invention.

Figure 1:
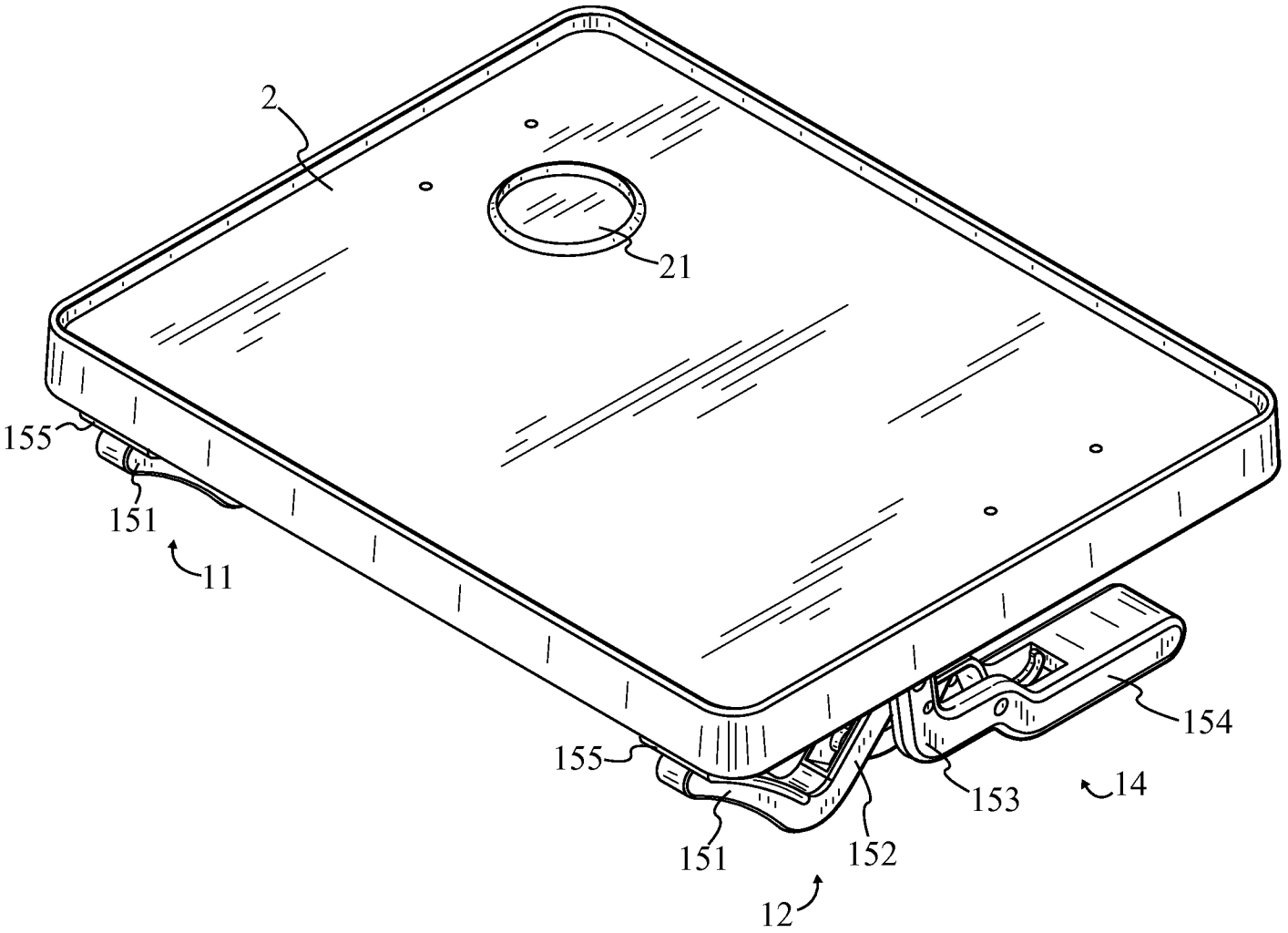
FIG. 1 is a perspective view of a first embodiment of the present invention.
Figure 2:
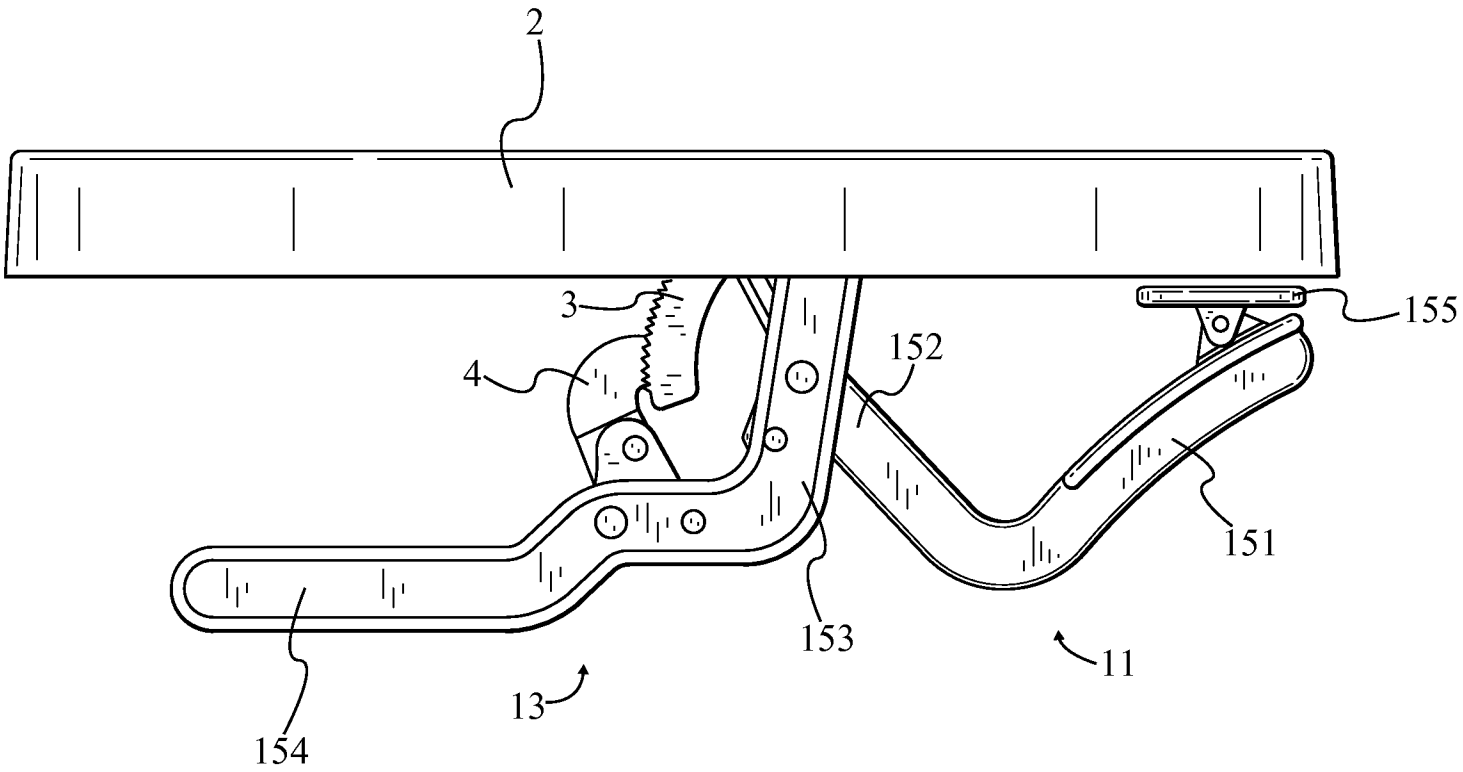
FIG. 2 is a left side view of the first embodiment of the present invention.
Figure 3:
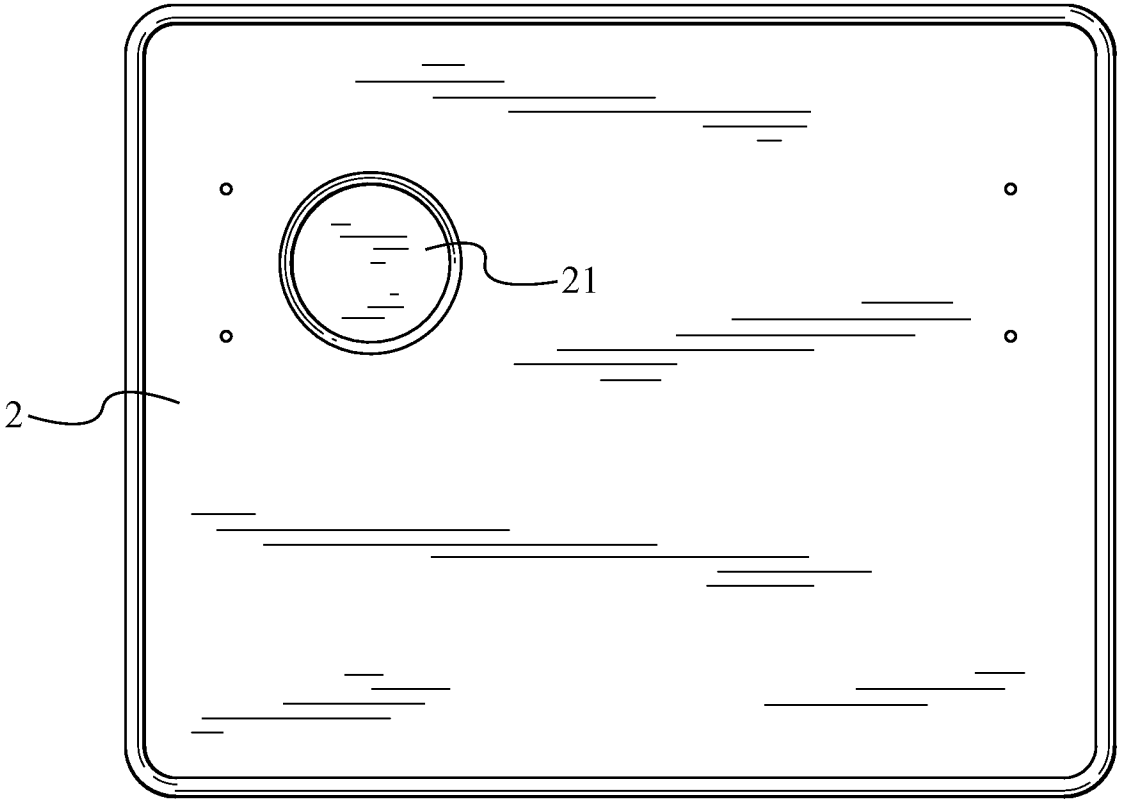
FIG. 3 is a top plan view of the first embodiment of the present invention.
Figure 4:
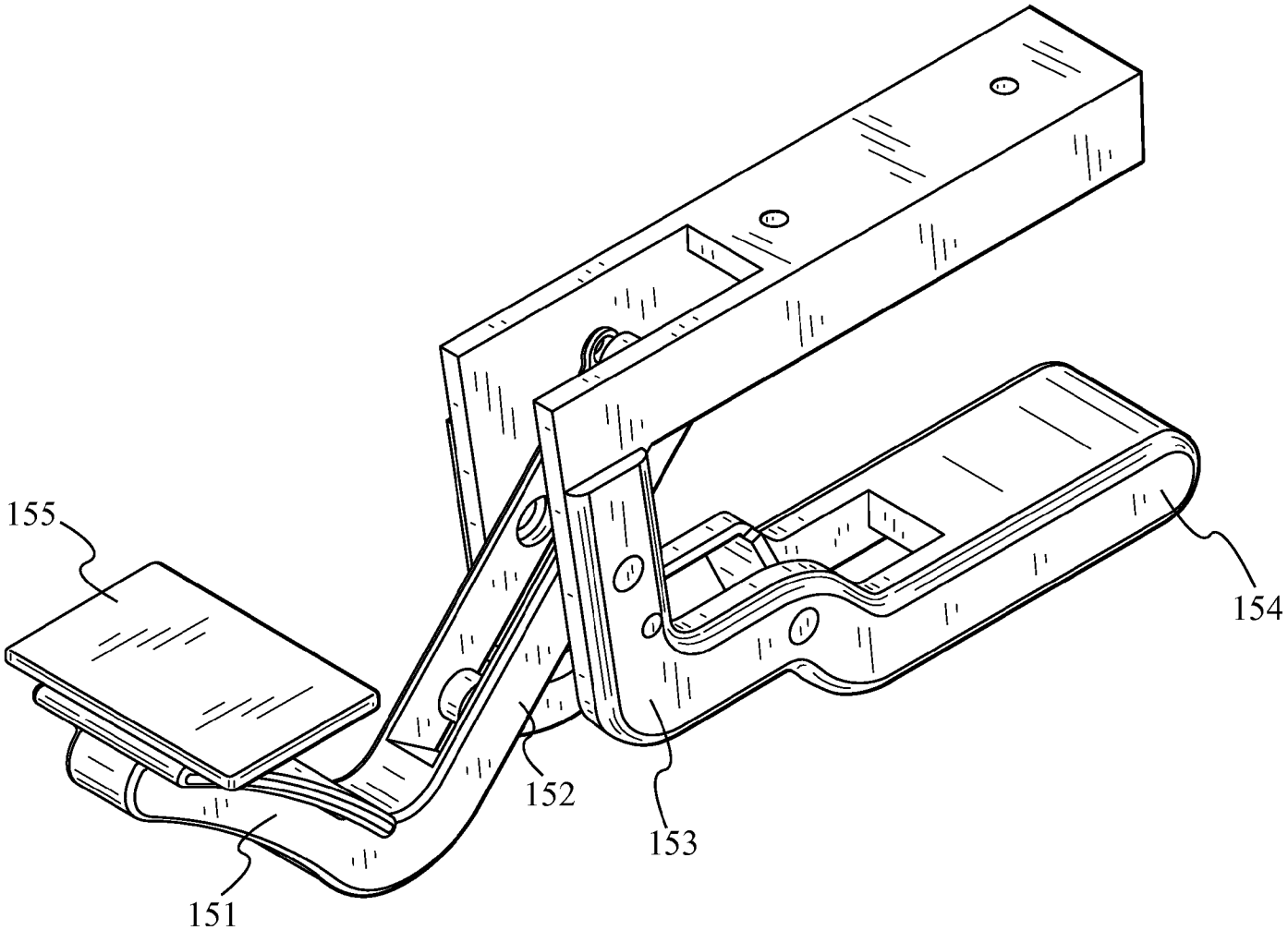
FIG. 4 is a perspective view of a clamp and a handle of the first embodiment of the present invention.
Figure 5:
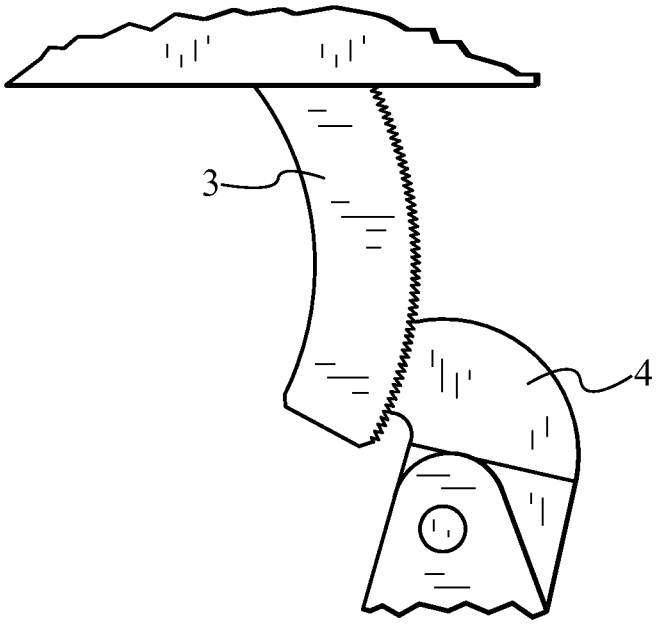
FIG. 5 is a right side view showing a locking mechanism and a retention mechanism of the first embodiment of the present invention.
Figure 6:
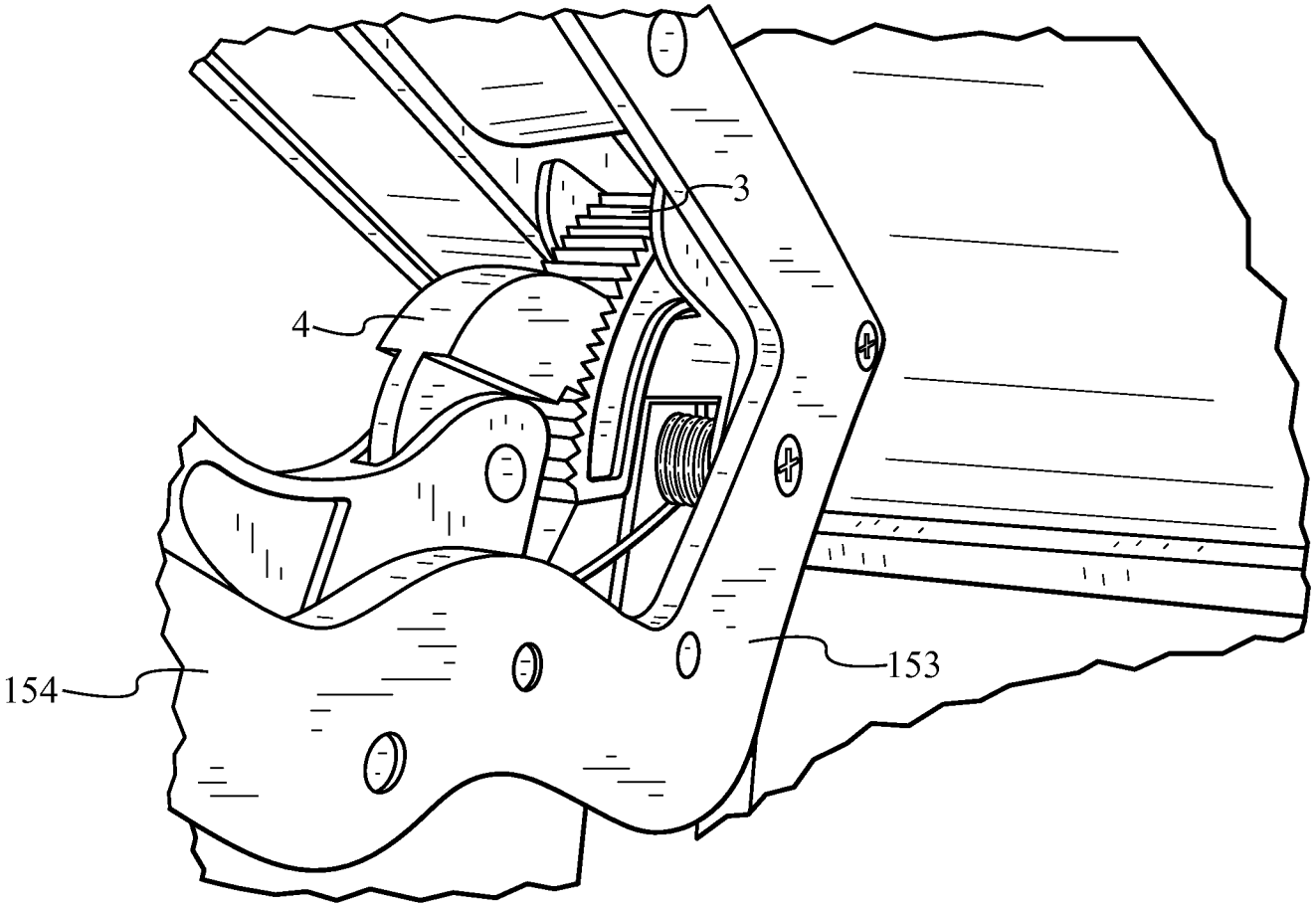
FIG. 6 is an enhanced perspective view showing the engaged retention mechanism and locking mechanism of the first embodiment of the present invention.
Figure 7:
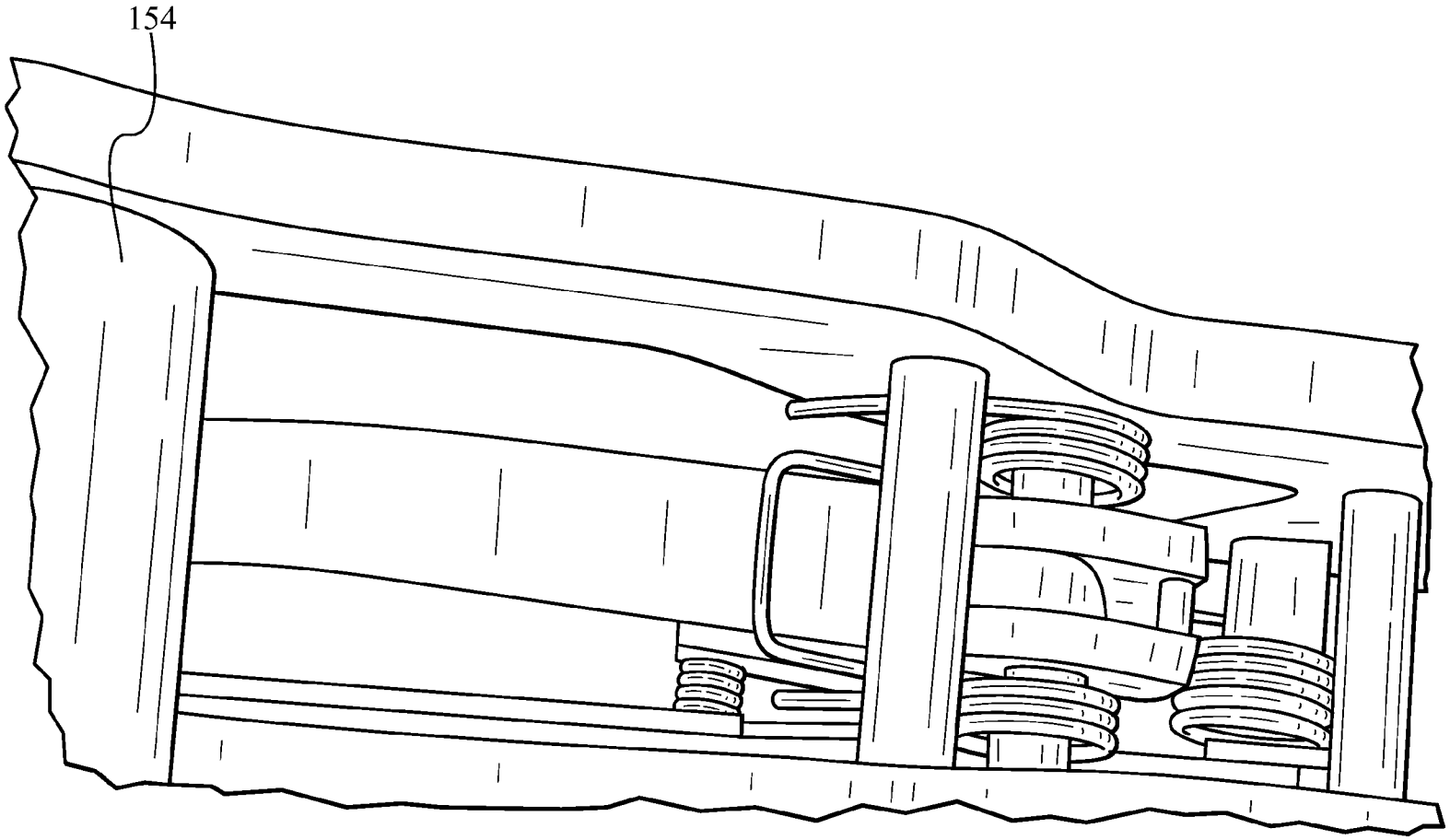
FIG. 7 is another enhanced view showing a portion of the first embodiment of the present invention.

The first embodiment, provided for horizontal features such as tables, comprises a first clamp 11, a second clamp 12, a first handle 13, a second handle 14, and a planar body 2 as shown via FIG. 1-FIG. 3. To allow the clamps to be switched between a clamped configuration and a free configuration, the first clamp 11 is pivotably connected to the first handle 13 while the second clamp 12 is pivotably connected to the second handle 14. This enables the first clamp 11 and the second clamp 12 to be pivoted and pressed against a horizontal feature, as necessary for securing the first embodiment to such a horizontal feature. The first clamp 11 and the second clamp 12 each comprise a clamping arm 151, a pivot arm 152, and a locking mechanism 3, while the first handle 13 and the second handle 14 each comprise a mounting arm 153, a gripping portion 154, and a retention mechanism 4. The first handle 13 and the second handle 14 are positioned below the planar body 2, to which they are mounted via the respective mounting arms 153. The mounting arm 153 also serves as an axis of rotation for the first clamp 11 and the second clamp 12; the pivot arm 152 of each clamp is positioned adjacent to and pivotably connected to the corresponding mounting arm 153. The locking mechanism 3 is selectively engaged with the retention mechanism 4, allowing the first embodiment to be switched between a clamped configuration and an unclamped configuration as desired by a user. To actuate the retention mechanism 4, a trigger 31 is connected to the gripping portion 154. This provides a convenient and user friendly means for engaging and disengaging the retention mechanism 4 from the locking mechanism 3.

The pivot arm 152 is what allows the clamps to switch between the clamped configuration and unclamped configuration. Thus the pivot arm 152 of the first clamp 11 is pivotably connected to the mounting arm 153 of the first handle 13 while the pivot arm 152 of the second clamp 12 is pivotably connected to the mounting arm 153 of the second handle 14. To secure the pivot arms 152 in a clamped or unclamped configuration, the locking mechanism 3 of the first clamp 11 is selectively engaged with the retention mechanism 4 of the first handle 13. Similarly, the locking mechanism 3 of the second clamp 12 is selectively engaged with the retention mechanism 4 of the second handle 14. Movement of the pivot arm 152 results in corresponding movement of the clamping arm 151. The clamping arm 151 is positioned adjacent to the pivot arm 152, opposite the mounting arm 153 along the pivot arm 152. Thus, by moving the pivot arm 152 the clamping arm 151 can be moved towards or away from the planar body 2, as is necessary to switch between a clamped and unclamped configuration. The locking mechanism 3 is connected to the pivot arm 152, such that it is positioned adjacent to the mounting arm 153 and is capable of interacting with the retention mechanism 4.

The retention mechanism 4, which engages with the locking mechanism 3 to prevent movement of the pivot arm 152, is pivotably connected to the mounting arm 153. The retention mechanism 4 is actuated by the trigger 31, which causes the retention mechanism 4 to rotate; this enables switching between a clamped configuration and an unclamped configuration. The type of locking mechanism 3 and retention mechanism 4 implemented is variable, with one example being a ratchet design. In this example, the locking mechanism 3 is a ratchet gear whose teeth are blocked by a corresponding pawl that is the retention mechanism 4. The pawl can be disengaged from the ratchet gear via its pivoting connection to the mounting arm 153. This movement is actuated by a trigger 31, allowing a user to easily engage or disengage the locking mechanism 3 and retention mechanism 4. Potentially, the locking mechanism 3, the retention mechanism 4, or even both, can be spring-loaded such that they return to a default configuration (e.g. engaged with each other) when not being actuated by the trigger 31. These components of the clamps and handles are more visibly illustrated in FIG. 4-FIG. 7.

The planar body 2 of the first embodiment, which is shared with a second embodiment, provides a flat surface suitable for use with kitchenware or ultimately whatever items a user wishes to place on the planar body 2. Thus the planar body 2 comprises an at least one indent 21 which traverses into the planar body 2 through a top surface. This indent 21 allows items such as plates and cups to be securely placed on the planar body 2, with the indent 21 preventing undesired lateral movement of said items.

Operation of the first embodiment, such as being clamped to a horizontal feature (specified as a table for purposes of explanation), is subsequently described in more detail. To begin, the planar body 2 is positioned over the table, with the first clamp 11 and the second clamp 12 being positioned below the table. After being positioned by a user, the first clamp 11 and second clamp 12 can be used to secure the present invention to the table. A user accomplishes this by manually rotating the pivot arm 152 of each clamp such that the corresponding padded foot 155 is pressed against the bottom of the table. The padded foot 155 helps increase surface contact area of the clamp, provides a gentler surface to prevent damage to the table, and thanks to its ability to rotate, is usable with a variety of table thicknesses. Once the padded foot 155 has been pressed against the bottom of the table, it is automatically secured by means of the locking mechanism 3 and retention mechanism 4; as the locking mechanism 3 is a ratchet gear, the pawl only allows rotation of the ratchet gear in one direction. The retention mechanism 4 (i.e. the pawl) can be disengaged from the ratchet gear to allow the clamps to be released from the bottom of the table.

To release the clamps from the table and switch to an unclamped configuration, a user simply presses the trigger 31 to actuate the retention mechanism 4. The trigger 31, being connected to the retention mechanism 4, causes the retention mechanism 4 to pivot away from the locking mechanism 3, allowing the clamp arms to freely move. Using the example of a ratchet gear and pawl, when the pawl is pivoted away from the ratchet gear, the ratchet gear is capable of rotating clockwise and counter-clockwise. Resultantly, a user can loosen the clamps, which would normally be prevented by the pawl.

Thus, through use of the trigger 31, the clamps can be loosened and the first embodiment switched from a clamped configuration to an unclamped configuration. The first embodiment provides the ability to extend the usable area of tables, such as for providing a designating eating surface for a child. Thanks to the planar body 2 and indent 21, the first embodiment provides the means to securely hold plates, glasses, utensils, and other tableware.

Figure 8:
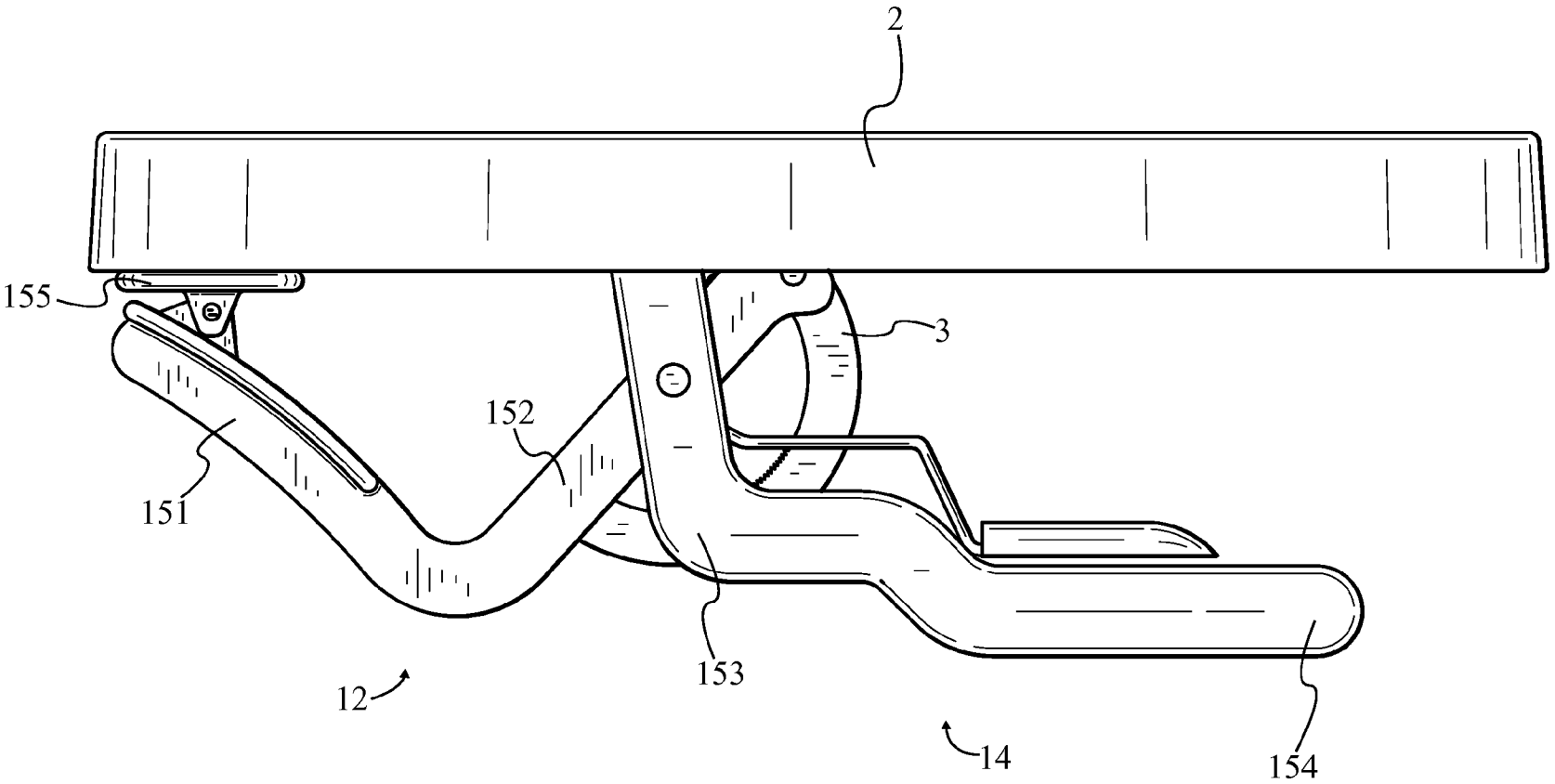
FIG. 8 is a right side view of a first alternative construction for first embodiment of the present invention.
Figure 9:
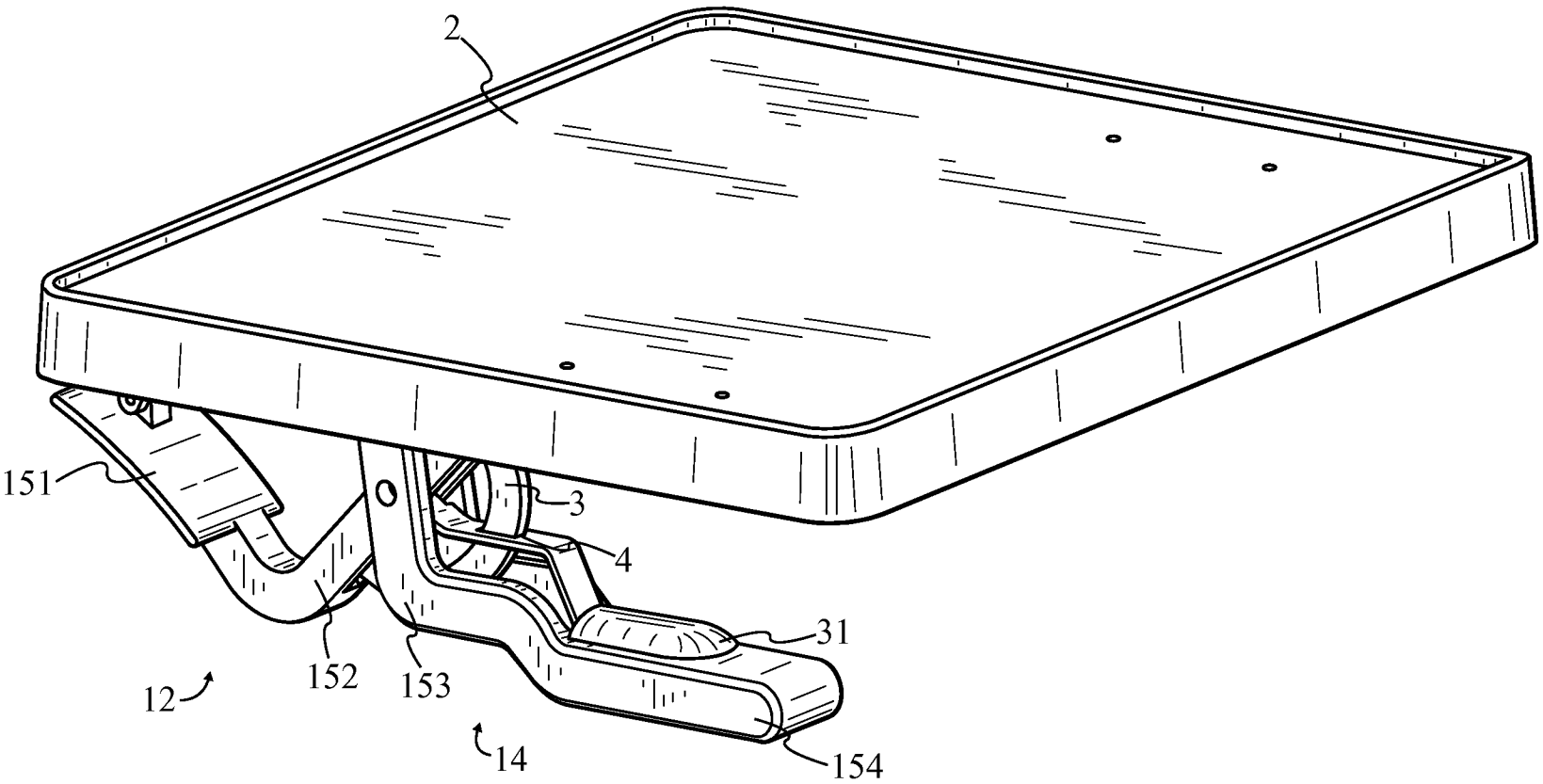
FIG. 9 is a perspective view of the first alternative construction for the first embodiment of the present invention.
Figure 10:
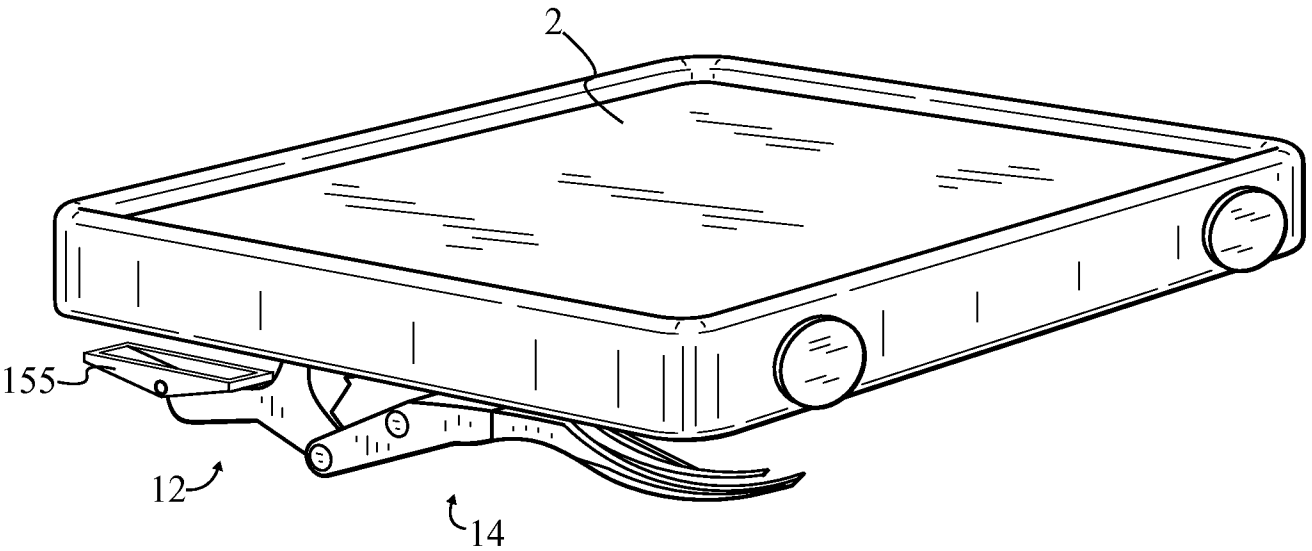
FIG. 10 is a perspective view of a second alternative construction for the first embodiment of the present invention.
Figure 11:
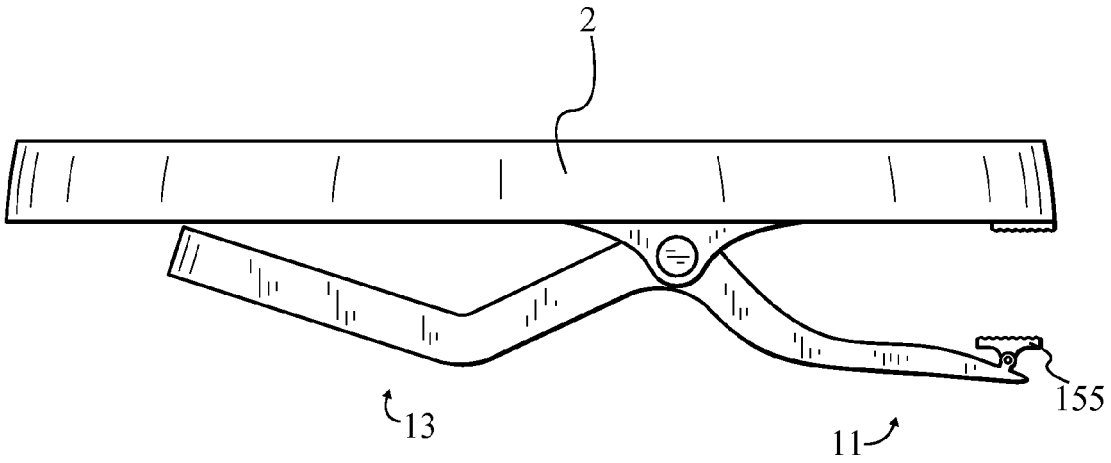
FIG. 11 is a left side view of a third alternative construction for the first embodiment of the present invention.
Figure 12:
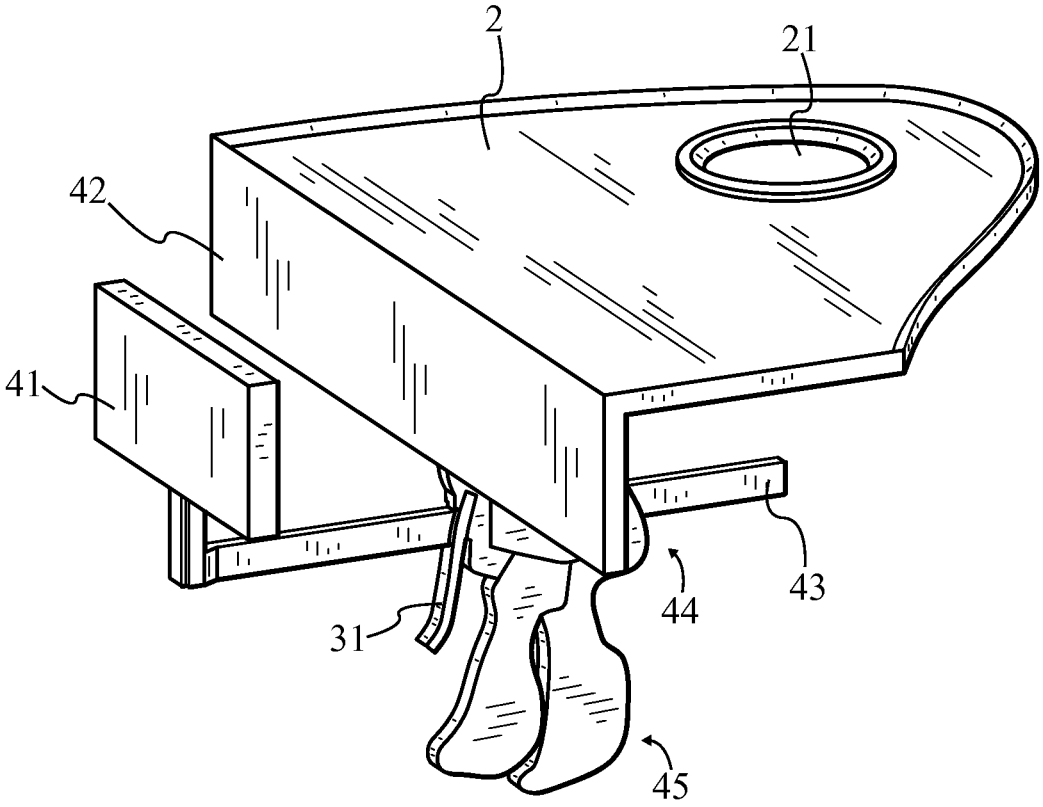
FIG. 12 is a perspective view of a second embodiment of the present invention.
Figure 13:
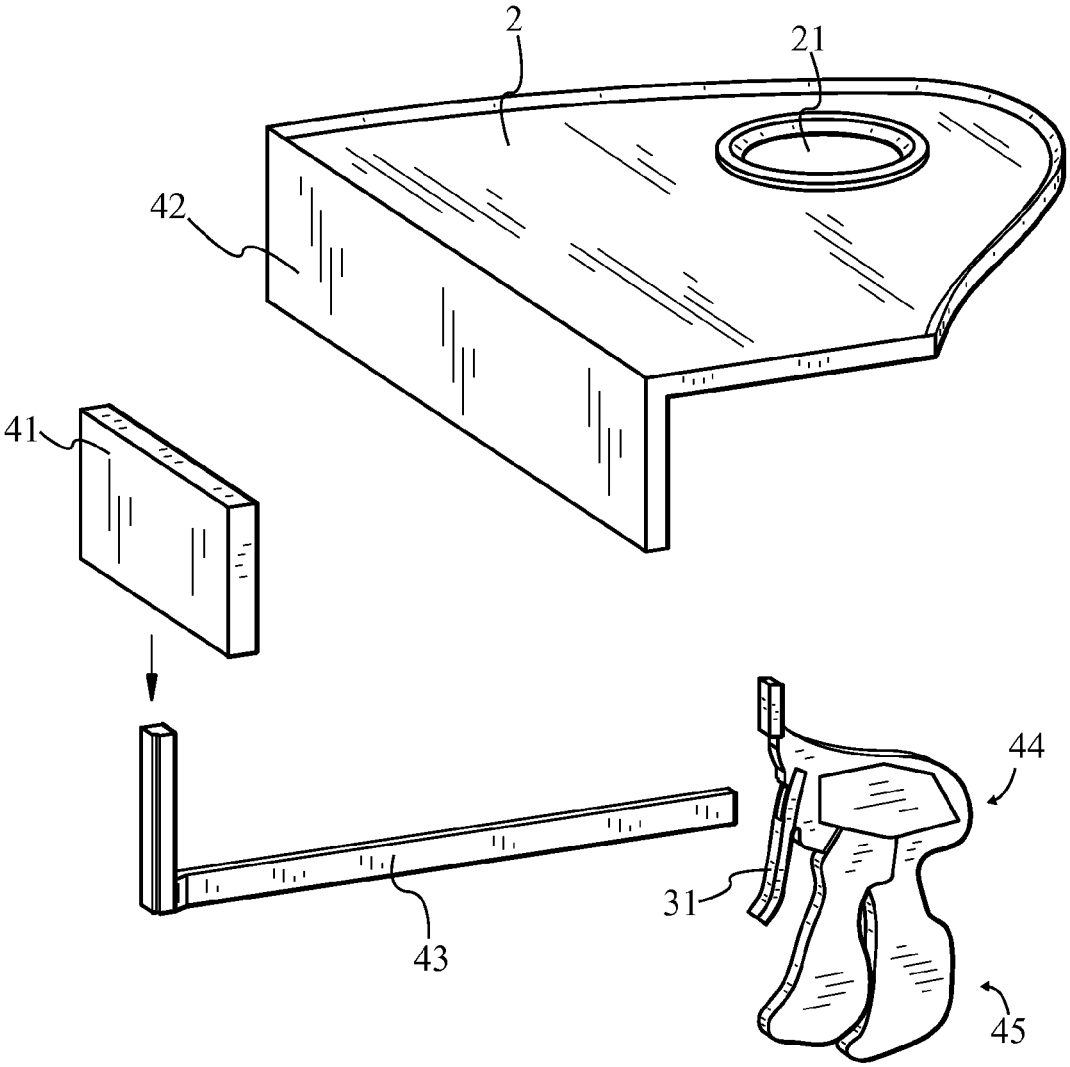
FIG. 13 is an exploded perspective view of the second embodiment of the present invention.
Figure 14:
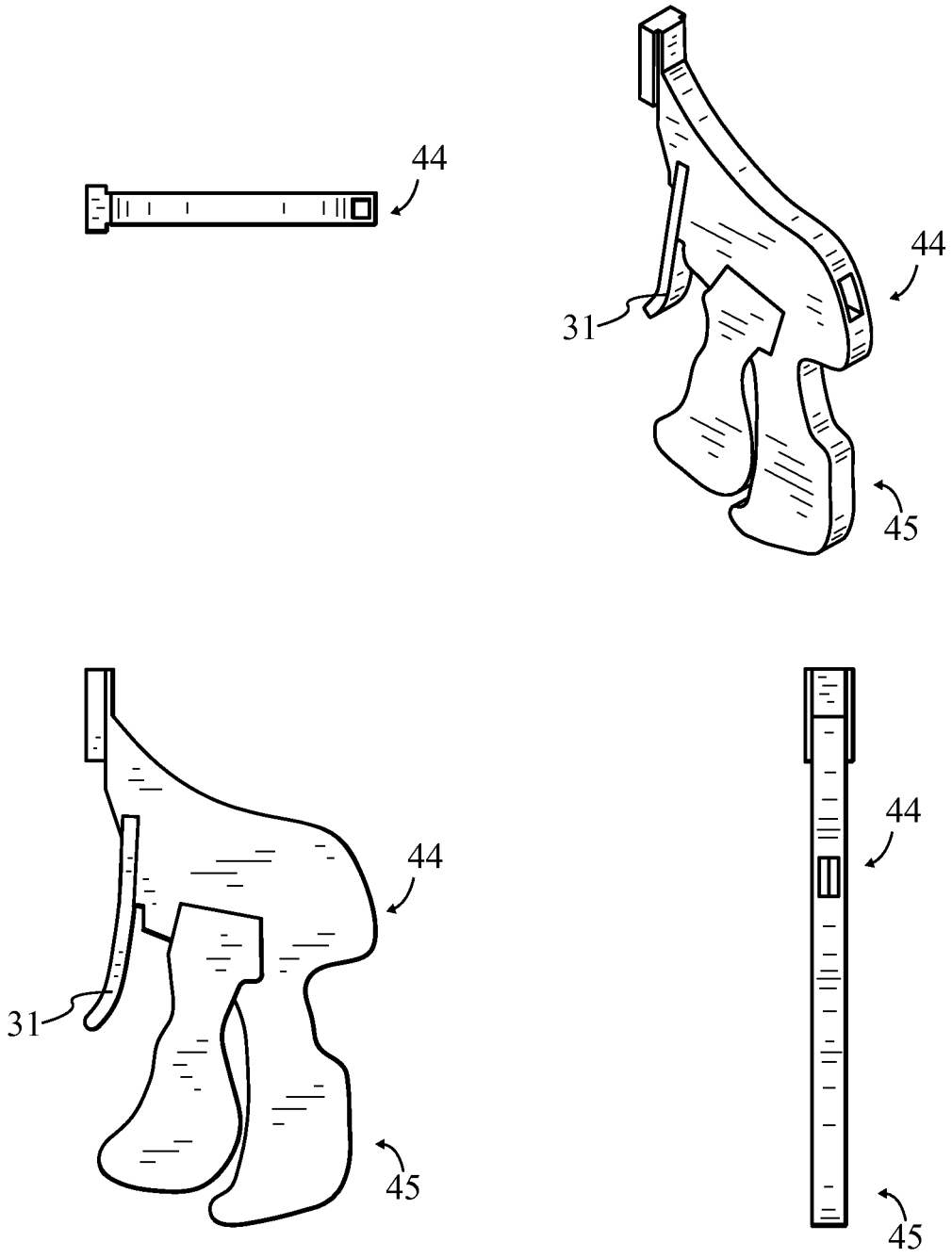
FIG. 14 is a combination of views showing a handle portion of the second embodiment of the present invention.
Figure 15:
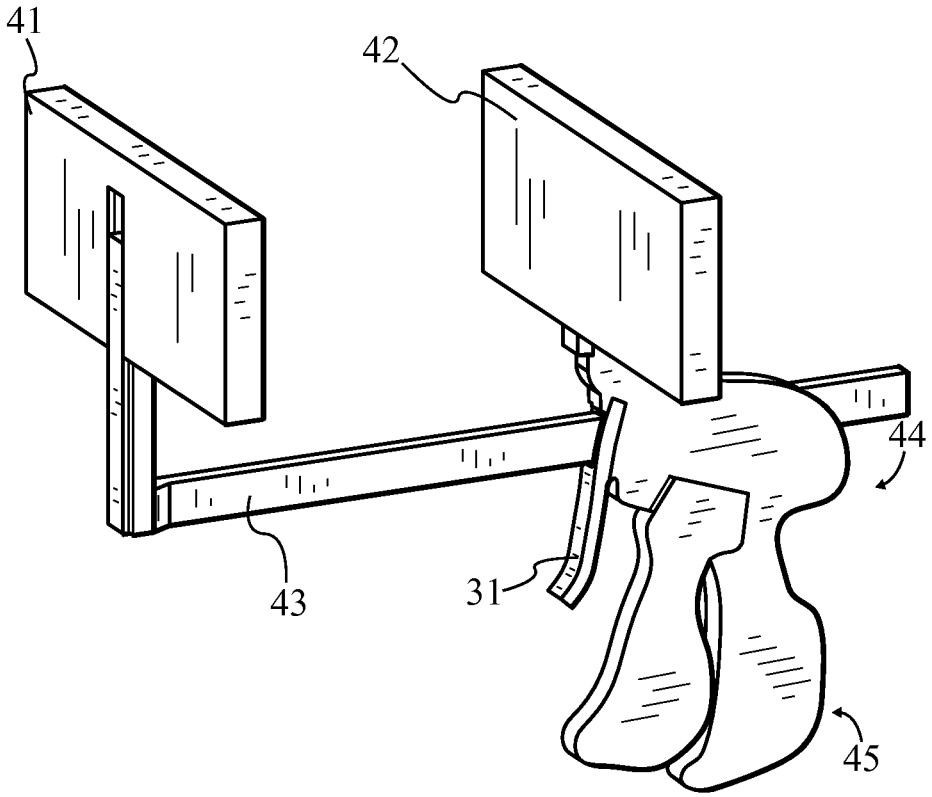
FIG. 15 is a perspective view of the potential retention mechanism of the second embodiment of the present invention, with top piece omitted for ease of disclosure.

Variations of the present invention, including the first embodiment and second embodiment, may utilize different clamping mechanisms than those heretofore described. Similarly, different designs of locking mechanisms 3 can be substituted for the previously provided examples of locking mechanisms 3. While plastic is considered as an advantageous material for the present invention due to its light weight, high tensile strength, and high compression strength, other materials are possible. Some examples of alternative materials include metal, PVC plastics, glass, and wood. Aesthetic characteristics of the present invention are also nebulous, with different coatings, colors, logos, and pattern schemes being possible for use with the present invention. Possible constructions for components of the present invention, including trigger 31, locking mechanism 3, and retention mechanism 4, are shown in FIG. 5-FIG. 11. In the standard first embodiment, the locking mechanism 3 (shown in FIG. 5 and FIG. 6) is of a ratchet gear design. This ratchet gear design can easily be connected to a rotating piece (e.g. a clamp) that rotates about a fixed point (e.g. a mounting section). A view showing a section of the locking mechanism 3 engaged with a section of the retention mechanism 4 is provided in FIG. 5. Shown in FIG. 8 and FIG. 9 is an alternative construction for the retention mechanism 4, which utilizes a push trigger construction, where the user can push on the grip to engage or disengage the locking mechanism 3 and retention mechanism 4 from each other. FIG. 10 provides a view of a potential trigger 31 for a second variant, which uses a vise grip in place of the ratchet construction in order to secure and release the present invention from a table or similar surface. A third variant utilizing a spring clamp implementation for the locking mechanism 3 and retention mechanism 4 is shown in FIG. 11. In all version of the first embodiment, pressing or released the trigger 31 actuates the retention mechanism 4 to engage or disengage it with the locking mechanism 3. The components and mechanisms shown in FIG. 5-FIG. 11 are just a few potential examples and not mean to preclude the use of alternative constructions of components and mechanisms.

The second embodiment, illustrated in FIG. 12-FIG. 15, comprises a stationary clamp jaw 41, a moveable clamp jaw 42, a planar body 2, an elongated track 43, a carriage 44, and a locking mechanism 3. The stationary clamp jaw 41 is connected to one end of the elongated track 43, while the moveable clamp jaw 42 is connected to the carriage 44, the latter being slidably engaged with the elongated track 43. Connected atop the moveable clamp jaw 42 is the planar body 2; resultantly, as the moveable clamp jaw 42 and carriage 44 slide along the elongated track 43, the planar body 2 moves correspondingly. By positioning a vertical feature such as an arm rest, between the stationary clamp jaw 41 and the moveable clamp jaw 42, the present invention can be clamped to said vertical feature and resultantly provide a planar surface for eating or other activities. This is accomplished by sliding the movable clamp jaw 42 to be adjacent to the vertical feature, with the moveable clamping jaw 42 pressing against the vertical feature. The provided locking mechanism 3 is used to retain the present invention in this clamped configuration.

Serving as a convenient interfacing point for a user, a handle 45 and a trigger 31 are also provided. The handle 45 is adjacently connected below the carriage 44; by being positioned below the carriage 44, a user can easily use the handle 45 to move the carriage 44 without being impeded by the planar body 2, which would be the case if the handle 45 were positioned above the carriage 44. The carriage 44 is thus positioned between the handle 45 and the moveable clamp jaw 42. As mentioned, the handle 45 provides a structure which is easy for a user to grasp and thus improves user ergonomics; rather than trying to grasp and move the carriage 44 itself, a user can hold the handle 45 to efficiently move the carriage 44 along the elongated track 43. Once the moveable clamp jaw 42 is pressed against the vertical feature, the locking mechanism 3 can be engaged to secure the second embodiment in a clamped configuration. The trigger 31 is provided to operate the locking mechanism 3 and is thus conveniently mounted to the handle 45. The trigger 31 is connected to the locking mechanism 3 in order to allow the locking mechanism 3 to be actuated by the trigger 31. The trigger 31 is physically connected to the locking mechanism 3 such that movement of the trigger 31 creates corresponding desired movement of the locking mechanism 3. Through use of the trigger 31 a user is able to engage or disengage the locking mechanism 3. This assists a user with converting the embodiment between a clamped and unclamped configuration. The handle 45 and trigger 31 are shown in more detail in FIG. 13 and FIG. 14.

To prevent undesired sliding of the moveable clamp jaw 42, the locking mechanism 3 is mounted to the carriage 44, where the locking mechanism 3 is selectively engaged with the elongated track 43. By engaging the locking mechanism 3 with the elongated track 43 via the trigger 31, translational movement of the carriage 44 is restricted. The locking mechanism 3 can be implemented in various ways; for example, the locking mechanism 3 could be a ratchet gear and pawl, allowing the clamp to easily be tightened. Alternatively, the locking mechanism 3 could be a vise that grips the elongated track 43 to prevent movement via friction. Another possibility utilizes a spring-loaded latch as the locking mechanism 3, with the spring-loaded latch engaging with corresponding pinholes on the elongated track 43. These examples are just a few possibilities of locking mechanisms 3 that can be implemented with the second embodiment and are not meant to limit the application of other locking mechanism 3 constructions.

As this embodiment of the present invention is also intended to provide a convenient and mobile eating apparatus, the planar body 2 serves as a flat and stable surface which can support plates, drinks, cutlery, and ultimately all items culinary or otherwise. To help retain items in a stationary position the planar body 2 comprises an at least one indent 21. The indent 21 traverses into the planar body 2, through a top surface, creating a recessed area that prevents lateral movement of an item placed in the indent 21. The indent 21 is preferably circular and sized to receive a plate or cup, or potentially can be sized to receive any culinary object which would commonly be placed on the planar body 2. For example, additional indents 21 could be provided to hold utensils and napkins.

Operation of the second embodiment, such as being clamped to a vertical feature (specified as an arm rest for purposes of explanation), is subsequently described in more detail. First, the stationary clamp jaw 41 is placed next to the arm rest. The arm rest should be positioned so that it is in between the stationary clamp jaw 41 and the moveable clamp jaw 42. Once the second embodiment has been positioned, a user grasps the handle 45 in order to move the carriage 44 along the elongated track 43. The user can thus easily move the carriage 44 and corresponding moveable clamp jaw 42 to press against the arm rest, on a side opposite the stationary clamp jaw 41. As the stationary clamp jaw 41 and moveable clamp jaw 42 press against the arm rest and create a normal force, frictional forces prevent the clamp jaws from falling off the arm rest due to gravity.

Once the moveable clamp jaw 42 has been laterally translated into a clamped configuration, the moveable clamp jaw 42 can be secured via the locking mechanism 3. The locking mechanism 3 is easily engaged or disengaged from the elongated track 43 by means of the trigger 31. By pressing or depressing the trigger 31, the user can engage the locking mechanism 3 with the elongated track 43 (e.g. in order to prevent movement of the carriage 44 and moveable clamp jaw 42) or disengage the locking mechanism 3 from the elongated track 43 (e.g. in order to allow movement of the carriage 44 and moveable clamp jaw 42). By using the locking mechanism 3 to secure the second embodiment in a clamped configuration, the planar body 2 is coupled to an arm rest. The result is a convenient utility surface for a person's benefit.

As the present invention is intended as a food tray, use generally encompasses holding plates, cutlery, food, and other dining relating items. The indent 21 helps to prevent items on the planar body 2 from sliding around. For example, by positioning a plate in the indent 21, the plate will remain in place even if a user accidentally knocks or otherwise moves the planar body 2. Without the indent 21, such unintended movement could result in items falling off the planar body 2 and becoming spoiled (in the case of food) or damaged (e.g. in the case of plates). Multiple indents 21 can be provided, allowing a dining set including cutlery, a plate, and a glass to be securely placed on the planar body 2 by means of the indents 21.

Although the invention has been explained in relation to its preferred embodiment, it is to be understood that many other possible modifications and variations can be made without departing from the spirit and scope of the invention as hereinafter claimed.

What is claimed is:

1. A tray attachment comprises:
a first clamp;
a second clamp;
a first handle;
a second handle;
a planar body;
the first clamp being pivotably connected to the first handle;
the second clamp being pivotably connected to the second handle;
the first clamp and the second clamp each comprise a locking mechanism;
the first handle and the second handle each comprise a retention mechanism;
the locking mechanism of the first clamp being selectively engaged with the retention mechanism of the first handle;
the locking mechanism of the second clamp being selectively engaged with the retention mechanism of the second handle;
the first handle and the second handle each comprise a trigger;
the trigger of the first handle being connected to the gripping portion of the first handle;
the trigger of the second handle being connected to the gripping portion of the second handle;
the trigger of the first handle being operatively coupled to the retention mechanism of the first handle, wherein engaging the trigger disengages the retention mechanism from the locking mechanism of the first clamp; and
the trigger of the second handle being operatively coupled to the retention mechanism of the second handle, wherein engaging the trigger disengages the retention mechanism from the locking mechanism of the second clamp.

2. The tray attachment as claimed in claim 1 comprises:
the first clamp and the second clamp each further comprise a clamping arm and a pivot arm;
the first handle and the second handle each further comprise a mounting arm and a gripping portion;
the pivot arm of the first clamp being pivotably and adjacently connected to the mounting arm of the first handle; and
the pivot arm of the second clamp being pivotably and adjacently connected to the mounting arm of the second handle.

3. The tray attachment as claimed in claim 1 comprises:
the clamping arm of the first clamp being positioned opposite the mounting arm of the first handle along the pivot arm of the first clamp; and
the clamping arm of the second clamp being positioned opposite the mounting arm of the second handle along the pivot arm of the second clamp.

4. The tray attachment as claimed in claim 1 comprises:
the first clamp and the second clamp being positioned below the planar body;
the pivot arm of the first clamp being adjacently connected to the clamping arm of the first clamp;
the pivot arm of the second clamp being adjacently connected to the clamping arm of the second clamp;
the locking mechanism of the first clamp being adjacently connected to the pivot arm of the first clamp; and
the locking mechanism of the second clamp being adjacently connected to the pivot arm of the second clamp.

5. The tray attachment as claimed in claim 1 comprises:
the locking mechanism being a ratchet gear and the retention mechanism being a pawl, wherein the pawl restricts rotation of the locking mechanism when engaged to the ratchet gear.

6. The tray attachment as claimed in claim 1 comprises:
a clamping arm comprises a padded foot;
the padded foot being pivotably connected to the clamping arm;
the padded foot being positioned opposite the handle arm along the clamping arm; and
the padded foot being pressed against the planar body.

7. The tray attachment as claimed in claim 1 comprises:
the planar body comprises an at least one indent;
the at least one indent being positioned on the planar body; and
the at least one indent being positioned on a top surface of the planar body.

8. The tray attachment as claimed in claim 7 comprises:
the at least one indent being circular, wherein the at least one indent is adapted to receive tableware.

9. A tray attachment comprises:
a first clamp;
a second clamp;
a first handle;
a second handle;
a planar body;
the first clamp being pivotably connected to the first handle;
the second clamp being pivotably connected to the second handle;
the first clamp and the second clamp each comprise a clamping arm, a pivot arm, and a locking mechanism;
the first handle and the second handle each comprise a mounting arm, a gripping portion, a retention mechanism, and a trigger;
the clamping arm comprises a padded foot;
the planar body comprises an at least one indent;
the pivot arm of the first clamp being pivotably and adjacently connected to the mounting arm of the first handle;
the pivot arm of the second clamp being pivotably and adjacently connected to the mounting arm of the second handle;
the clamping arm of the first clamp being positioned opposite the mounting arm of the first handle with respect to the pivot arm of the first clamp;
the clamping arm of the second clamp being positioned opposite the mounting arm of the second handle with respect to the pivot arm of the second clamp;
the locking mechanism of the first clamp being selectively engaged with the retention mechanism of the first handle;

the locking mechanism of the second clamp being selectively engaged with the retention mechanism of the second handle; and the locking mechanism being a ratchet gear and the retention mechanism being a pawl, wherein the pawl restricts rotation of the locking mechanism when engaged to the locking mechanism.

10. The tray attachment as claimed in claim 9 comprises:

the trigger of the first handle being connected to the gripping portion of the first handle;

the trigger of the second handle being connected to the gripping portion of the second handle;

the trigger of the first handle being connected to the locking mechanism of the first clamp, wherein engaging the trigger of the first handle disengages the locking mechanism of the first clamp from the retention mechanism of the first handle; and the trigger of the second handle being connected to the locking mechanism of the second clamp, wherein engaging the trigger of the second handle disengages the locking mechanism of the second clamp from the retention mechanism of the second handle.

11. The tray attachment as claimed in claim 9 comprises:

the first clamp and the second clamp being positioned below the planar body;

the pivot arm of the first clamp being adjacently connected to the clamping arm of the first clamp;

the pivot arm of the second clamp being adjacently connected to the clamping arm of the second clamp;

the locking mechanism of the first clamp being adjacently connected to the pivot arm of the first clamp; and the locking mechanism of the second clamp being adjacently connected to the pivot arm of the second clamp.

12. The tray attachment as claimed in claim 9 comprises:

the padded foot being pivotably connected to the clamping arm;

the padded foot being positioned opposite the handle arm along the clamping arm; and the padded foot being pressed against the planar body.

13. The tray attachment as claimed in claim 9 comprises:

the at least one indent being positioned on the planar body; and the at least one indent being positioned on a top surface of the planar body.

14. The tray attachment as claimed in claim 9 comprises:

the at least one indent being circular, wherein the at least one indent is adapted to receive tableware.

* * * * *